United States Patent [19]

Zemel et al.

[11] Patent Number: 4,712,006

[45] Date of Patent: Dec. 8, 1987

[54] STEAM QUALITY MEASUREMENT APPARATUS AND METHOD

[75] Inventors: Bernard Zemel; Philip J. Closmann, both of Houston, Tex.

[73] Assignee: Shell Oil Company, Houston, Tex.

[21] Appl. No.: 770,115

[22] Filed: Aug. 27, 1985

[51] Int. Cl.[4] ..... G01V 5/08

[52] U.S. Cl. ..... 250/269; 250/256

[58] Field of Search ..... 250/256, 269; 378/51-56, 66-67

[56] References Cited

U.S. PATENT DOCUMENTS

| | | | |
|---|---|---|---|
| 2,470,224 | 5/1949 | Scherbatskoy | 250/83.6 |
| 2,722,609 | 11/1955 | Morgan et al. | 378/51 |
| 2,737,592 | 3/1956 | Ohmart | 250/43.5 |
| 2,896,084 | 7/1959 | Macdonald | 378/51 |
| 2,932,740 | 4/1960 | Widmyer | 250/268 |
| 3,103,812 | 9/1963 | Bourne, Jr. et l. | 250/269 |
| 3,183,351 | 5/1965 | White | 250/43.5 |
| 3,431,415 | 3/1969 | Stone | 250/83.1 |
| 3,524,502 | 8/1970 | Sloan | 166/250 |
| 3,794,836 | 2/1974 | Hinckfuss | 378/53 |
| 3,800,145 | 3/1974 | Caldwell | 250/253 |
| 4,057,729 | 11/1977 | Hewitt | 250/390 E |
| 4,127,169 | 11/1978 | Tubin et al. | 166/250 |
| 4,185,691 | 1/1980 | Tubin et al. | 166/250 |
| 4,409,480 | 10/1983 | Givens | 250/256 |
| 4,499,380 | 2/1985 | Aggour et al. | 250/390 C |

FOREIGN PATENT DOCUMENTS

| | | | |
|---|---|---|---|
| 7706867 | 12/1977 | Netherlands | 250/256 |

*Primary Examiner*—Craig E. Church
*Assistant Examiner*—John C. Freeman

[57] ABSTRACT

An apparatus and method are disclosed for determining the steam quality of a steam-water mixture prior to passage of the mixture from a steam injection well into steam-floodable formations located adjacent the well. The apparatus which may be lowered down into a steam injection well comprises a radiation emitting source located a selected distance away from a radiation detecting source. The steam-water mixture passes between the emitter and the detector. In operation an increase in the water content of the mixture causes attenuation of the radiation received by the detector. The decrease in the radiation received by the detector decreases the output signal of the detector. Corresponding signal changes as the steam quality of the mixture varies may be studied to determine the existing downhole steam quality at a particular location in the well.

10 Claims, 2 Drawing Figures

STEAM QUALITY MEASUREMENT APPARATUS AND METHOD

BACKGROUND OF THE INVENTION

1. Field of the Invention

This invention concerns an apparatus and method utilizing gamma radiation monitoring techniques for determining the relative mass fractions of steam and water passing through a conduit.

2. Description of the Prior Art

There are numerous situations in which it is desirable to characterize a substance by the concentration of water or some other hydrogenous material contained therein. In one class of these situations the density of the hydrogenous material is macroscopically constant across the substance and a sample of the substance may be readily isolated for analysis. Substances generally falling within this class include grain, wood, soils, slurries, etc. Where time for analysis is not limited, a sufficiently accurate measure of the concentration of hydrogenous material in such substances can generally be obtained through the use of techniques well familiar to those skilled in the art.

However, where the substance in question is at an extremely high temperature, is highly corrosive, exists only transiently or is not readily accessible, obtaining an accurate measure of the concentration of hydrogenous material therein can be difficult or impossible by traditional methods of chemical or physical analysis. One class of substances that in certain situations has proven especially resistant to common methods of analysis includes vapor-liquid mixtures such as wet steam.

It is frequently important that the steam quality at some point in a process or apparatus utilizing steam be known. Steam quality is defined as the mass ratio of the pure steam vapor to the total fluid within a steam sample and is usually expressed as a percentage. Commonly utilized methods of measuring steam quality include sodium titration analysis, calorimetric analysis and relative volume analysis by phase separation. These methods require fluid access to the steam and are time consuming and labor-intensive. Accordingly, it has proven impracticable to provide continuous, rapid steam quality monitoring at any point in a steam system for which access to the steam itself cannot be obtained. Without such continuous rapid analysis, accurate control of steam quality often cannot be attained. Furthermore, existing methods of chemical and physical steam quality analysis are especially inadequate in certain applications due to the increasing inaccuracy of such methods with increasing steam pressure and temperature.

It would be especially desirable to develop a simple and accurate steam quality monitoring system for use in conjunction with steam injection systems for oil fields. It is becoming an increasingly common practice to inject high pressure, high quality steam into an oil-bearing formation to stimulate the production of oil therefrom. The injected steam serves to heat the hydrocarbons in the formation causing their viscosity to drop and, hence, their rate of flow through the formation to increase. The steam also provides a displacing action. In order to optimize the efficiency of this recovery technique and to improve reservoir performance predictions, it is important that the steam quality of the injected fluid be known at the point of injection into the well formation. The steam quality is preferably maintained at an optimum value dependent on the specific nature of the operation. It is desirable that an apparatus and method be provided for constantly monitoring the steam quality at the point of injection of the steam water mixture into the formations being flooded and, in response to deviations between the desired and the actual steam quality, to automatically adjust the operation of the steam generator to maintain the steam quality at the desired value. It is further desirable that such steam quality monitoring apparatus be so constructed as to be suitable, with a minimum of adjustment, for use within any steam injection well within a wide range of configurations. It is also desirable that the apparatus and method provide results accurate at low steam pressures as well as above 11.7 MPa (1700 psi), a point beyond which most traditional methods of steam quality monitoring become either impracticable or inaccurate. It is further desirable that the apparatus and method be accurate over a wide range of steam quality extending above 70%, where the total amount of hydrogenous material within the conduit is relatively small.

It is important to note that as the steam-water mixture travels downhole the steam may condense when flowing into a well recently placed on stream, until the casing material is heated sufficiently. Alternatively, the steam-water mixture may be geothermally heated sufficiently in passing downward in the well to cause an increase in the steam quality prior to injection into the formation. It is imperative, therefore, that a steam quality measurement device be developed that may be lowered into the well to a position above the location where the steam-water mixture enters the formation.

Two different apparatus that may be used for measurement of a hydrogenous material are disclosed in U.S. Pat. Nos. 4,499,380 and 4,057,729.

In U.S. Pat. No. '380 issued Feb. 12, 1985, an apparatus is disclosed that measures steam quality and is mounted at a surface location outside of the steam carrying conduit. The apparatus includes a source of fast neutrons, a moderating medium, and a neutron detection system positioned adjacent the steam-water mixture which provides an output signal representative of the time rate of occurrence of neutron detection.

The disadvantages of this system is its overall bulkiness and its inability to measure the steam quality of the steam-water mixture at the point in the well where the mixture enters the formation. The U.S. Pat. No. '380 apparatus can only determine the steam quality at the surface of the well.

A system similar to the U.S. Pat. No. '380 for use in determining the concentration of a cellulose slurry has also been disclosed in U.S. Pat. No. '729, issued Nov. 8, 1977. This system includes a source of fast neutrons suspended within the slurry and a relatively bulky thermal neutron detection system positioned within the slurry at a spaced distance from the source. It should be noted that a fast neutron moderation/attenuation shield system must be included in these devices for them to operate properly. From the detection rate of thermalized neutrons, the concentration of the water within the slurry can be determined. Drawbacks to such a system are that no provision is made for monitoring samples of low hydrogen density such as that found in normal steam quality ranges and that in many circumstances it is impracticable to position either a source or a detector within a sample.

For example, the overall intrusive bulkiness of a system of this nature would inherently cause steam quality measurement errors if inserted into a flowing steam injection well. The pressure disturbances caused by such a device if it is placed in a typically pressure sensitive steam-water mixture would tend to yield questionable results at best.

An apparatus and method need be developed therefore that measures the steam quality of a flowing steam-water mixture immediately before the mixture flows into a subterranean formation. The apparatus therefore needs to be positionable downhole in a steam injection well, and be sufficiently compact and non-intrusive so as to yield reliable steam quality measurements.

SUMMARY OF THE INVENTION

The steam quality measurement apparatus of the present invention comprises a radiation emitter source located a selected distance away from a radiation detector, both the detector and the emitter capable of longitudinal movement and selective positioning within a conduit containing a hydrogenous material. The apparatus may be calibrated to determine the density of a hydrogenous material which passes through the apparatus.

The apparatus may be lowered within a steam injection well, and be positioned above the place in the well where the steam-water mixture flows into adjacent steam floodable formations. The apparatus will therefore sense the steam quality at the point of injection of the steam water mixture into the formation.

Surface adjustments in the steam quality entering the well will therefore insure that the proper quality steam is flooded into the formations, since the steam quality will vary as the steam water mixture descends into the well due to heating and/or cooling effects of the surrounding well casing.

The apparatus can advantageously measure in-situ the steam-water mixture immediately prior to its entrance into the formation, which insures that the thermal energy required to form such a steam-water mixture is most efficiently used.

The apparatus is shaped to cause the lowest pressure drop to the steam-water mixture passing through the apparatus, to insure accurate steam quality readings.

Since the apparatus may be lowered and subsequently retrieved from a steam injection well, only one apparatus need be fabricated to monitor several wells.

The mobility of the apparatus within the well allows a complete analysis to be made of the variation of the steam quality along the length of the well as the steam-water mixture flows downwardly into the well.

It is an object of the invention therefore to provide a steam quality measurement apparatus for use in monitoring the steam quality of a steam-water mixture flowing through a portion of a conduit such as a steam injection well.

It is a feature of the invention to provide such an apparatus with emitter means located within said conduit, the emitter means having an emitter source characterized by the emission of radiation, and to provide such an apparatus with radiation detection means capable of providing an output signal proportional to the amount of radiation received from said emitter means, the radiation detection means having a radiation detector which produces the output signal, the detector also located inside the conduit a spaced distance from the emitter means.

These and other features, objects, and advantages of the present invention will become apparent from the following detailed description, wherein reference is made to the Figures in the accompanying drawings.

DESCRIPTION OF THE PREFERRED EMBODIMENT

Figure 1:
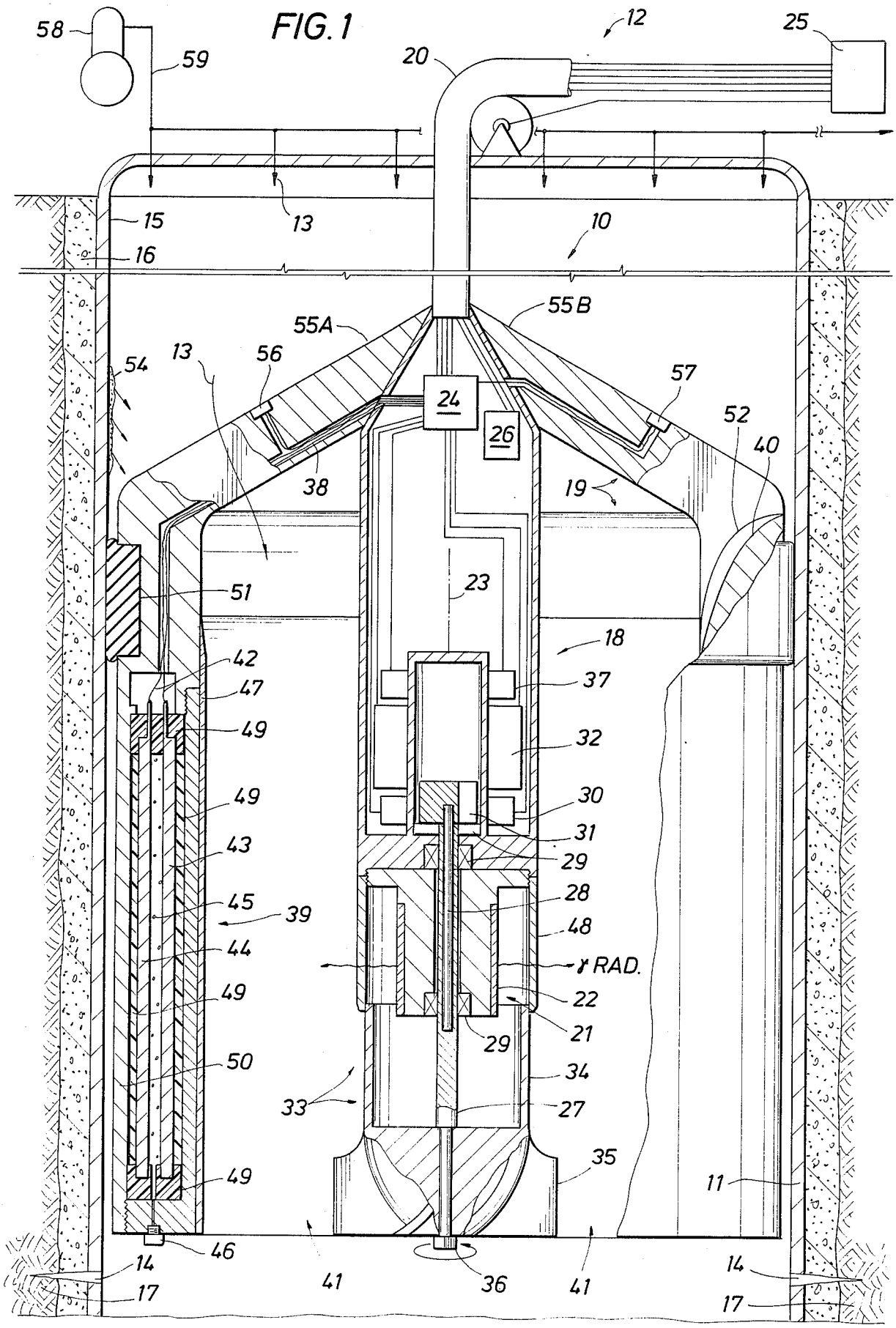
FIG. 1 is a schematic representation showing the steam quality measurement apparatus lowered within a steam injection well.

Referring now to FIG. 1 a steam quality measurement apparatus 10 is shown lowered down the throughbore 11 of a steam injection well 12. It should be noted that the drawing is not drawn to scale, for the purposes of clarity and to show with greater detail the construction and assembly of the interior elements of the tool 10. The actual tool 10 will present a much smaller frontal cross-sectional area to the steam-water mixture 13 which flows through the tool 10.

The apparatus 10 is shown positioned above perforation openings 14 that are perforated from the throughbore 11, typically through the casing 15 and cement 16 that lines the sides of well 12, to steam-floodable formations 17 located exterior to the well throughbore 11. It is well recognized that the apparatus 10 may be positioned at any location in the throughbore 11.

The steam quality measurement apparatus 10 can be seen to be comprised essentially of the emmiter means 18 and radiation detection means 19.

The emitter means 18 which forms the first major portion of the apparatus 10 is shown in a preferred embodiment centrally located within the well throughbore 11 and suspended from electrical conduit 20 which may be lowered from the upper end of the well 12 throughbore 11 or in this instance from a surface location. It is well recognized that whereas the apparatus 10 is shown positioned within a well throughbore 11 the apparatus 10 may be lowered and positioned through any type of conduit well known to the art. The apparatus 10, for example, may be used to determine fluid density that exists in a pipeline section. The apparatus 10 can be moved through the pipeline for example, by a dispersable gel plug well known to the art to a desired location. Whereas, in a preferred embodiment, the apparatus 10 is shown monitoring the steam-water mixture 13 steam quality, it is well recognized that this apparatus 10 may be used to determine the density of any suitable hydrogenous material such for example as a water base slurry which carries suspended particulate material.

The emitter means 18 has an emitter source 21 which is characterized by the emission of radiation. In a preferred embodiment, the radiation will take the form of gamma rays well known to the art. The emitter source 21 in this instance is formed from selected radioactive material 22 such as cesium 137 or americium 240, both materials 22 known for their generation of gamma radiation. In a preferred embodiment, the radioactive material 22 is shown positioned about a central longitudinal axis 23 of the emitter means 18, though it is well recognized that many other geometric configurations may be used.

A signal processor 24 is shown located in the upper end of the emitter means 18 and is used for producing and receiving signals to and from a surface signal processor 25 via the electrical conduit 20. Signal processors 24, 25 may take the form of multiplex data processors well known to the art. A power supply 26 is also shown carried within the upper end of the emitter means 18 and is used for supplying power to the signal processor 24. It is well recognized, of course, that in an alternative embodiment the signal processor 24 will not be carried within emitter means 18 due to high temperature design limitations of the components forming the processor 24.

In a preferred embodiment a rotatable shaft 27 is shown positioned coaxial with the central longitudinal axis 23 of the emitter means 18. A portion of the shaft 27 is fabricated with a magnetic core 28. The shaft 27 is vertically moveable with respect to the emitter means 18 and may also rotate freely within bearings 29 as is well known to the art.

Sensor coils 30 carried by the emitter means 18 are shown located adjacent a portion of the magnetic core 28 of the rotatable shaft 27 and are capable of sensing the elevation of the shaft 27 relative to the emitter means 18. The coils 30 may also detect the rotation of the shaft 27 about its central longitudinal axis 23 by being placed proximate to an additional magnet 31 which causes magnetic pulses to be sensed by the sensor coils 30 upon each rotation of the shaft 27, thereby giving a measure of the steam-water mixture flow rate.

An electromagnet 32 is shown disposed adjacent a portion of the magnetic core 28 of the rotatable shaft 27, the electromagnet 32 being capable of being energized by the signal processor 24 by power supplied from the power source 26 to the signal processor 24. The electromagnet 32 thereafter causes the rotatable shaft 27 to move vertically upward relative to the emitter means 18. It is well recognized that other means may be used to raise the rotatable shaft 27, such as by the energization of a hydraulic piston and cylinder arrangement (not shown) that may be installed or operatively connected to the upper end of the rotatable shaft 27. In the preferred embodiment, however, magnetic interaction between the electromagnet 32 and the magnetic core 28 will typically cause the shaft 27 to move upwards, by means well known to the art.

In a preferred embodiment, calibration means 33 will be included in the emitter means 18, the calibration means 33 being capable of calibrating the amount of radiation emitted from the emitter source 21. The calibration means 33 may be operatively connected to the rotatable shaft 27 and may become positioned about the emitter source 21 upon energization of the electromagnet 32. The electromagnet 32 may be energized by power supplied from the power source 26 to the signal processor 24, and thereafter to the electromagnet 32, though it is well recognized that other means of energization of the electromagnet 32 may be used. As shown in FIG. 1 a calibration section 34 having a particular thickness of a selected material will become positioned in front of the emitter source 21 when the electromagnet 32 is energized, which causes the rotatable shaft 21, 27 to move upwards.

The lower end of the calibration means 33 may form blades 35 which extend radially outward from the central longitudinal axis 23 of the rotatable shaft 27. The blades 35 may be designed to rotate the rotatable shaft 27 when impinged upon by the steam water mixture 13 when the mixture passes through the apparatus 10. It is well recognized, however, that the steam quality of the steam-water mixture may still be accurately measured without the inclusion of blades 35 to apparatus 10.

Since it is desirable for the apparatus 10 to be able to operate properly in different well flowing conditions, the combined calibration section 34 and blades 35 of the calibration means 33 may be easily interchanged between different well locations by removal of a retainer means 36 such as a nut and lock washer well known to the art located at the end of shaft 27. Additionally, the emitter source 21 may also be interchanged before installation in various wells 12 which have different operating conditions. In this manner various combinations of calibration means 33 and emitter sources 21 may be utilized and interchanged without affecting the rest of the mechanism of the emitter means 18. The calibration means 33 may be formed for example from aluminum in one situation or well flow environment and from a steel and aluminum laminate in another well flow environment, by means well known to the art in order to manufacture a survivable piece of equipment that also has proper radiation attenuation properties to allow proper calibration of the emitter source 21.

It should be noted that when the electromagnet 32 is energized and the calibration section 34 of the calibration means 33 is positioned closely adjacent to the emitter source 21, calibration sensor coils 37 will determine the rate of rotation of the rotatable shaft 27 and also verify that the shaft 27 has moved vertically upward.

Radiation detection means 19 form the second major portion of the apparatus 10. The radiation detection means 19 provide an output signal 38 to the signal processor 24 proportional to the amount of radiation received from the emitter means 18. The radiation detection means 19 have a radiation detector 39 such as a scintillation counter, geiger counter, proportional counter, or ion chamber all well known to the art. In a preferred embodiment, an ion chamber is used which is capable of providing the output signal 38. In a preferred embodiment, the detector 39 is shown located adjacent the periphery of the well throughbore 11 in a substantially tubular manner and extends longitudinally alongside and at a spaced distance from the emitter means 18. The upper end of the radiation detector 39 is shown forming an upper inwardly sloping shoulder 40 shown in cross section in FIG. 1, the shoulder 40 capable of directing the steam-water mixture 13 into a tubular aperture 41 which is formed between the detector 19 and emitter 18 means.

The radiation detector 39 output signal 38 leaves the connection 42 made at the upper end of a positive electrode 43 and a negative electrode 44. In a preferred embodiment a pressurized gas 45 such as argon may fill the void between the cylindrical electrodes 43, 44, having entered the radiation detector 39 through gas charge connection 46. It is well recognized that the electrodes 43, 44 may be formed in segments. The negative electrode 44 which may be formed from brass shim stock may be coated with an active material such as cadmium, magnesium or zinc by means well known to the art whereas the positive electrode 45 which may be formed from brass shim stock may be coated with lead dioxide or collodial graphite by means well known to the art such as described in U.S. Pat. No. 2,737,592 issued Mar. 6, 1956. Of course, it is well recognized that a standard gas filled ion chamber well known to the art may be used for the radiation detector 39. In operation gamma radiation leaving the emitter source 21 will cause the ionization of the gas 45 which will subsequently cause a differential charge to develop between the electrodes 44, 43 which will generate a current or output signal 38 proportional to the amount of gamma radiation received by the radiation detector 39, all by means well known to the art.

To insure that the maximum amount of gamma radiation is received by the radiation detector 39, the inner wall of the radiation detector 39 and the flow shield 48 of the emitter means may be fabricated and machined from a gamma permeable material such as brass. Insulation 49 such as Teflon well known to the art may be used to insure that the electrodes 43, 44 are properly insulated from each other and the remainder of the radiation detector 39. It is recognized that steel may also be used as the material for the inner wall of the radiation detector 39 and flow shield 48.

The outer wall 50 may preferably be formed from steel in order to contain the approximately 400–500 pound pressure of the argon gas 45 when charged at the surface location and also to form a sufficiently strong support for the packer 51 which is formed about the outer circumference of the upper end of the radiation detector 39. Placement of the packer 51 at the upper end of the radiation detector 39 eases the assembly of the radiation detectors 39 various layered components. As can be seen, the packer 51 is carried by the detector 39 and shaped so as to become operatively contacted with the well throughbore 11 when energized so as to form a seal between the throughbore !1 and the detector 39 by means well known to the art. Packer 51 when energized by means (not shown) well known to the art also stabilizes the apparatus 10 at a particular vertical location within the well throughbore 11.

Figure 2:
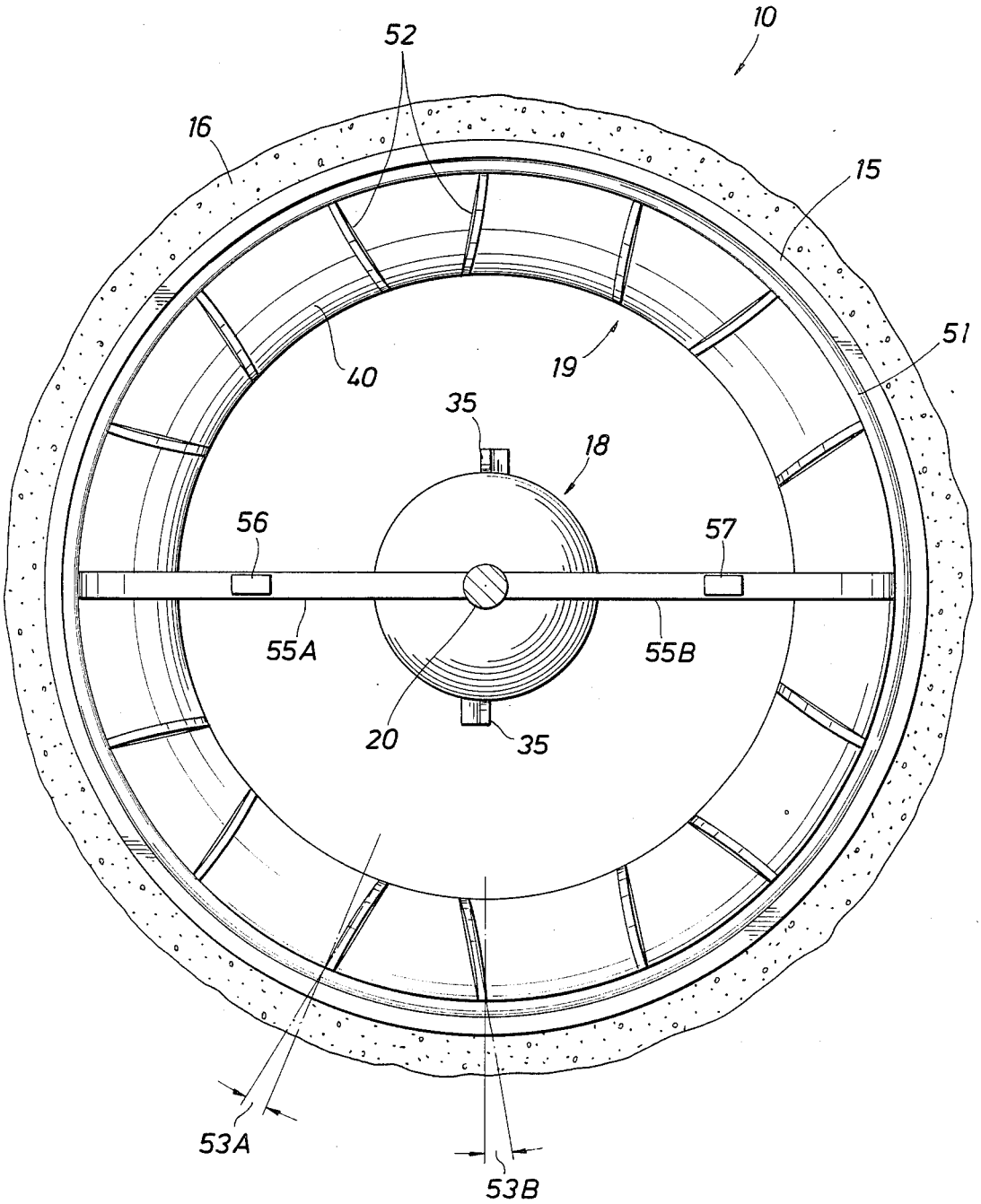
FIG. 2 is a schematic representation of the steam quality measurement apparatus taken from a plan view.

Referring now to FIGS. 1 and 2 a plurality of mixing vanes 52 in a preferred embodiment may be carried by the shoulder 40 and spaced equidistant from one another and alignable at alternating angles of incidence 53A, 53B relative to the central longitudinal axis 23 of the emitter means 18. The mixing vanes 52 will primarily assist in the recombination of a portion of water 54 that has become segregated from the steam-water mixture 13. In other words, any water 54 that may condense out upon the casing 15 as the steam-water mixture 13 flows downwardly into the well throughbore 11 will be recombined in a homogeneous manner with the remaining portion of the steam-water mixture 13 before the entire mixture 13 passes through the tubular aperture 41 between the emitter source 21 and the radiation detector 39. Rehomogenizing the entire steam-water mixture 13 in this manner will yield an output signal 38 more truly representative of the entire steam-water mixture 13 about to flow into the perforation openings 14 located below the apparatus 10. Alternating the angles of incidence 53A, 53B of mixing vanes 52 prevents a slug of water 54 from imposing an excessive rotation reaction upon apparatus 10 in a particular direction of rotation that would exceed the gripping force of the packer 51 in that particular direction.

The radiation detection means 19 also include a pair of support arms 55A, 55B, each arm having two ends, the first end of each arm 55A, 55B being connected to the radiation detector 39, the second end of each arm operatively connected to the emitter means 18, by means well known to the art, such as by welding. Note that the frontal cross sectional area of the support arms, 55A, 55B should be minimized to reduce the pressure drop across the total apparatus 10 and also to minimize flow disruptions of the steam-water mixture 13 prior to the mixtures' 13 passage through the apparatus 10.

In a preferred embodiment a pressure sensor 56 may be carried by one of the arms 55A, 55B, the sensor 56 capable of sensing the pressure of the steam-water mixture 13 prior to the pressure disruptions that may be encountered by the mixture 13 as it passes through the apparatus 10. The pressure sensor 56 may be that such as manufactured by Precise Sensors, Inc. of Monrovia, Calif. It is well recognized that the pressure sensor 56 may be placed in other locations.

A temperature sensor 57 may be carried by one of the arms 55A, 55B, the sensor 57 capable of sensing the temperature of the steam-water mixture 13 at the support arm 55A, 55B. The temperature sensor 57 may be a thermocouple well known to the art.

In operation a steam-water mixture 13 is initially generated by steam generator 58 and subsequently flowed through steam header 59 into at least one well 12, by means well known to the art. The steam-water mixture 13 will have a particular steam quality at the entrance into well 12. Prior to the flow of the steam-water mixture 13 downwardly into the well 12 the apparatus 10 may be lowered into well 12 to a position slightly above the perforation openings 14 formed from the inner portion of the well 12 throughbore 11 into the steam floodable formation 17. The packer 51 may be energized at this point. The entire steam-water mixture 13 then in order to reach the perforation openings 14 has to pass through the apparatus 10. The pressure and temperature of the mixture 13 is sensed by the pressure and temperature sensors 56, 57 respectively and these values transmitted through the electrical conduit 20 to the surface signal processor 25. The density of the mixture 13 is determined as the mixture 13 passes the emitter source 21 and the radiation detector 39. The amount of radiation attenuated by the mixture 13 indicates the appropriate steam quality 13 of the mixture 13. The higher the attenuation, the higher the water content of the steam and the lower the steam quality. The relative water content of the mixture 13 may also be determined by the rate of rotation of the rotatable shaft 27 caused by the water component of the mixture 13 impinging upon the blades 35 operatively connected to the shaft 27.

The apparatus 10 therefore comprises a device which senses the pressure, temperature, density, and relative flow rate of a steam-water mixture that passes a particular location in a conduit such as well throughbore 11. By variation of the location of the apparatus 10 within the conduit or throughbore 11, the steam quality of the steam-water mixture 13 may be determined at any point within the well throughbore 11.

The relative density of the steam-water mixture 13 may be determined by calibration of the apparatus 10 by passage of a known steam quality steam-water mixture 13 through the apparatus 10 for example at a suitable surface test facility. Alternatively, the apparatus 10 may initially be positioned at the upper end of the well 12 where a known quality steam-water mixture 13 is passing downwardly through the well 12. In this location the apparatus 10 may be calibrated by comparison with the known steam quality passing through the apparatus 10.

To minimize the pressure drop through the apparatus 10 and thereby minimize the inaccuracy of the readings taken by the apparatus 10, the frontal cross-section area and inherently to some extent the total volume occupied by the apparatus 10 must be minimized. For this reason, a gamma radiation source coupled with an ion chamber both well known to the art has been selected to sense the density of the steam-water mixture 13. The choice of this combination of source and detector minimizes the amount of apparatus 10 volume required to generate an accurate steam quality signal. It should be noted that the selection of the combination of fast neutron sources and their associated neutron detectors typically require that additional moderating shielding be included in the apparatus. The fast neutrons must be slowed or thermalized sufficiently by this moderating shielding before accurate readings of the steam quality can be made.

A gamma radiation source 21 coupled with ion detector 39, alternatively, requires no such bulky thermalizing shielding system, and therefore the apparatus 10 of the present invention is able to present a much smaller frontal cross section area to the steam-water mixture 13, and therefore cause less of a pressure drop of the mixture 13 as the mixture 13 passes through the apparatus 10.

It will be apparent to those familiar with this field that other types of sources 21 and detectors 39 can be substituted within the scope of the method and apparatus of the present invention. It is well recognized, for example, that fast neutron sources and detectors may be used to measure the steam quality of mixture 13, if the resulting apparatus 10 is compact. It should also be recognized that more than one emitter source 21 may be used, and that for example alternating sources 21 and detectors 39 may be arranged about the periphery of throughbore 11. This arrangement would remove the central emitter means 18 from the center of the throughbore, with the possible result of increasing the thickness of the apparatus 10 about the periphery of the throughbore 11. In any event it is well recognized that the frontal cross-sectional area of the apparatus 10 should be minimized.

Many other variations and modifications may be made in the apparatus and techniques hereinbefore described, both by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

We claim:

1. A steam quality measurement apparatus for use in monitoring the steam quality of a steam-water mixture passing down the throughbore of a steam injection well, said steam quality measurement apparatus comprising;

emitter means centrally located with respect to a central longitudinal axis, said emitter means having; electrical conduit means connected to said emitter means, an emitter source characterized by the emission of radiation, said emitter source formed from selected radioactive material positioned about said central longitudinal axis of said emitter means, signal processing means located in the emitter means to process an output signal so as to monitor the steam quality, radiation detection means capable of providing said ouptut signal substantially proportional to the amount of radiation received from said emitter means, said radiation detection means having;

a radiation detector providing said output signal and located in a tubular manner and extending longitudinally alongside and at a spaced distance from said central longitudinal axis, a packer formed about an outer circumference of said radiation detector, said packer carried by said detector and operatively contacted with said well throughbore so as to form a seal between said well throughbore and said detector, and a tubular aperture defined in an annular manner between said emitter means and said radiation detection means and located at an upper and so as to direct substantially all of said steam-water mixture passing downward through said throughbore.

2. The apparatus of claim 1 wherein said steam quality measurement apparatus further includes;

calibration means positionable about said emitter source to calibrate said emitter source, a shaft vertically moveable with respect to said emitter means, said calibration means being operatively connected to said shaft, an electromagnet disposed adjacent a portion of said shaft, said electromagnet when energized capable of vertically moving said shaft and moving said calibration means about said emitter source, and means for energizing said electromagnet.

3. The apparatus of claim 1 wherein the upper end of said radiation detector forms an upper inwardly-sloping shoulder to direct the steam-water mixture into said tubular aperture formed between said detector and said emitter means.

4. The apparatus of claim 1 wherein said steam quality measurement apparatus further includes;

at least one support arm, said arm having two ends, the first end of said arm operatively connected to said radiation detector, the second end of said arm operatively connected to said emitter means.

5. A steam quality measurement apparatus for use in monitoring the steam quality of a steam-water mixture passing through said apparatus, said steam quality measurement apparatus comprising;

emitter means centrally located along a central longitudinal axis, said emitter means having;

an electrical conduit means connected to said emitter means, an emitter source characterized by the emission of radiation, said emitter source formed from selected radioactive material, calibration means for the calibration of said emitter source, signal processor means for producing and receiving signals to and from a surface signal processor via said electrical conduit means to process an output signal so as to monitor the steam quality a power source for supplying power to said signal processor, a shaft vertically moveable with respect to said emitter means, a portion of said shaft having a magnetic core, sensor coils carried by said emitter means located adjacent a portion of said magnetic core of said shaft to sense the elevation of said shaft, an electromagnet disposed adjacent a portion of said magnetic core of said shaft, when energized capable of vertically moving said shaft, means for energizing said electromagnet, said calibration means operatively connected to said shaft and positionable about said emitter source upon energization of said electromagnet, and radiation detection means capable of providing an output signal to said signal processor proportional to the amount of radiation received from said emitter means, said radiation detection means having;

a radiation detector providing said output signal and located in a tubular manner and extending longitudinally alongside and at a spaced distance from said central longitudinal axis, the upper end of said radiation detector forming an upper inwardly-sloping shoulder to direct the steam-water mixture into a tubular aperture formed between said detector and said emitter means, a packer formed about an outer circumference of said radiaton detector, said packer carried by said detector and energization means to enable said packer to operatively contact said well throughbore so as to form a seal between said well througbore and said detector, at least one support arm, said arm having two ends, the first end of said arm operatively connected to said radiation detector, the second end of said arm operatively connected to said emitter means, a pressure sensor carried by said arm for sensing the pressure of said steam-water mixture at said support arm, and a temperature sensor carried by said arm for sensing the temperature of said steam-water mixture at said support arm.

6. A steam quality measurement apparatus with means to monitor the steam quality of a steam-water mixture passable through said apparatus, said steam quality measurement apparatus comprising;

emitter means centrally located along a central longitudinal axis and said emitter means connected to electrical conduit means said emitter means having;

an emitter source capable of emitting radiation, said emitter source formable from selected radioactive material, said material positionable in a cylindrical manner about said central longitudinal axis of said emitter means, calibration means capable of calibrating said emitter source, a signal processor means capable of producing and receiving signals to and from a surface signal processor via said electrical conduit, means to process an output signal so as to monitor the steam quality a power source capable of supplying power to said signal processor, a rotatable shaft vertically moveable with respect to said emitter means, the central longitudinal axis of said shaft capable of being positioned coaxial with the central longitudinal axis of said emitter means, a portion of said shaft having a magnetic core, sensor coils carriable by said emitter means locatable adjacent a portion of said magnetic core of said shaft capable of sensing the elevation and rotation velocity of said shaft, an electromagnet disposable adjacent a portion of said magnetic core of said rotatable shaft and capable of being energized and thereafter vertically moving said rotatable shaft relative to said emitter means, means for energizing said electromagnet, said calibration means operatively connectable to said rotatable shaft and positionable about said emitter source upon energization of said electromagnet, the lower end of said calibration means forming blades extendable radially outward from said central longitudinal axis of said rotatable shaft, said blades capable of rotating said rotatable shaft when impinged upon by said steam-water mixture, and radiation detection means capable of providing said output signal to said signal processor proportional to the amount of radiation receivable from said emitter means, said radiation detection means having;

a radiation detector capable of providing said output signal, said detector being locatable adjacent the periphery of said well throughbore in a substantially tubular manner and extendable longitudinally alongside and at a spaced distance from said emitter means, the upper end of said radiation detector forming an upper inwardly-sloping shoulder capable of directing the steam-water mixture into a tubular aperture formable between said detector and said emitter means, a plurality of mixing vanes carriable by said shoulder spaced equidistant from one another and alignable at alternating angles of incidence relative to the central longitudinal axis of said emitter means, said vanes capable of recombining a portion of water segregated from said steam-water mixture back into said steam-water mixture when said vanes are immersed in said steam-water mixture, a packer formable about an outer circumference of the upper end of said radiation detector, said packer carriable by said detector and shaped to become operatively contactable with said well throughbore when energized to form a seal between said well throughbore and said detector, at least one support arm, said arm having two ends, the first end of said arm connectable to said radiation detector, the second end of said arm operatively connectable to said emitter means, a pressure sensor carriable by said arm capable of sensing the pressure of said steam-water mixture at said support arm when said pressure sensor is immersed in said steam-water mixture, and a temperature sensor carriable by said arm capable of sensing the temperature of said steam-water mixture at said support arm when said temperature sensor is immersed in said steam-water mixture.

7. A steam quality measurement apparatus for use in monitoring the steam quality of a steam-water mixture passing through said apparatus, said steam quality measurement apparatus comprising;

emitter means centrally located with respect to a central longitudinal axis and connected to electrical conduit means, said emitter means having;

an emitter source characterized by the emission of radiation, said emitter source formed from selected radioactive material positioned about said central longitudinal axis of said emitter means, signal processing means located in said emitter means to process an output signal so as to monitor the steam quality radiation detection means capable of providing said output signal proportional to the amount of radiation received from said emitter means, said radiation detection means having;

a radiation detector providing said output signal and located in a tubular manner and extending longitudinally alongside and at a spaced distance from said central longitudinal axis, calibration means for the calibration of said emitter source, a shaft vertically movable with respect to said emitter means, a portion of said shaft having a magnetic core, sensor coils carried by said emitter means located adjacent a portion of said magnetic core of said shaft to sense the elevation of said shaft relative to said emitter means, an electromagnet disposed adjacent a portion of said magnetic core of said shaft, when energized capable of vertically moving said shaft, and means for energizing said electromagnet, said calibration means operatively connected to said shaft and positionable about said emitter source upon energization of said electromagnet.

8. The apparatus of claim 7 wherein said steam quality measurement apparatus further includes;

a signal processor for producing and receiving signals to and from a surface signal processor via said electrical conduit, and a power source for supplying power to said signal processor.

9. A method of adjusting the steam quality of a steam-water mixture flowing into a steam-floodable located adjacent a steam injection well, by use of a steam quality measurement apparatus, said apparatus having a radiation emitting source and a radiation detector located a spaced distance away from said emitting source, and having a tubular aperture defined in an annular manner between said emitting source and said radiation detector, said method comprising the steps of:

lowering said apparatus within said well, positioning said apparatus in said well above the location in said well where said steam-water mixture flows into said steam-floodable formation, flowing said steam-water mixture from a surface location down said well, through said tubular aperture of said apparatus, and into said steam-floodable formation, determing the quality of said steam-water mixture flowing through said apparatus by monitoring the amount of radiation detected by said radiation detector, and adjusting the quality of said steam-water mixture at said surface location.

10. The method of claim 9 further including, prior to the step of determining the quality of said steam-water mixture flowing through said apparatus, the step of;

calibrating a particular amount of radiation received by said radiation detector to a particular quality of said steam-water mixture.

* * * * *